US010968015B2

(12) United States Patent
Francoeur

(10) Patent No.: US 10,968,015 B2
(45) Date of Patent: Apr. 6, 2021

(54) VENTING DEVICE FOR A DISPOSABLE FOOD CONTAINER

(71) Applicant: Thomas J. Francoeur, West Islip, NY (US)

(72) Inventor: Thomas J. Francoeur, West Islip, NY (US)

( * ) Notice: Subject to any disclaimer, the term of this patent is extended or adjusted under 35 U.S.C. 154(b) by 0 days.

(21) Appl. No.: 15/950,960

(22) Filed: Apr. 11, 2018

(65) Prior Publication Data

US 2018/0290810 A1 Oct. 11, 2018

Related U.S. Application Data

(60) Provisional application No. 62/484,255, filed on Apr. 11, 2017.

(51) Int. Cl.

| | |
|---|---|
| ***B65D 81/26*** | (2006.01) |
| ***B65D 51/16*** | (2006.01) |
| ***B65D 21/02*** | (2006.01) |
| ***A47G 21/00*** | (2006.01) |
| ***B26B 3/04*** | (2006.01) |
| ***B26F 1/32*** | (2006.01) |

(52) U.S. Cl.

CPC ..... *B65D 51/1611* (2013.01); *A47G 21/00* (2013.01); *B26B 3/04* (2013.01); *B26F 1/32* (2013.01); *B65D 21/0201* (2013.01); *B65D 81/263* (2013.01); *B65D 81/266* (2013.01); *B65D 2205/02* (2013.01)

(58) Field of Classification Search

CPC ..... B65D 51/2835; B65D 51/1611; B65D 81/263; B65D 81/266; B65D 21/0201; B65D 51/285; B65D 81/26; A47G 21/06

USPC ..... 206/219, 215; 99/473

See application file for complete search history.

(56) References Cited

U.S. PATENT DOCUMENTS

| | | | | |
|---|---|---|---|---|
| 3,187,918 | A * | 6/1965 | Moore | A61J 9/00 215/11.6 |
| 5,505,326 | A * | 4/1996 | Junko | B65D 51/223 206/222 |
| 6,803,552 | B1 * | 10/2004 | Irizarry | H05B 6/6408 219/732 |
| 6,976,578 | B1 * | 12/2005 | Kenihan | B65D 51/2835 206/219 |
| 7,175,049 | B2 * | 2/2007 | Kastenschmidt | B65D 51/226 206/219 |
| 8,001,959 | B2 * | 8/2011 | Ford | B65D 81/3484 126/263.09 |
| 8,443,970 | B2 * | 5/2013 | Coon | B65D 51/2835 206/219 |
| 8,955,676 | B2 * | 2/2015 | Young | A47J 36/28 206/222 |

* cited by examiner

*Primary Examiner* — King M Chu

(74) *Attorney, Agent, or Firm* — Wilson, Elser, Moskowitz, Edelman & Dicker LLP

(57) ABSTRACT

A venting device and method for the retention of food temperature and texture is disclosed. The venting device of the present invention is inserted through the top, outside surface of a food container sufficiently to allow the device to puncture the surface of the container and allow venting of the steam and moisture created from the hot food within the takeout food container.

12 Claims, 5 Drawing Sheets

VENTING DEVICE FOR A DISPOSABLE FOOD CONTAINER

CROSS-REFERENCE TO RELATED PATENT APPLICATIONS

This application claims priority to U.S. Provisional Patent Application Ser. No. 62/484,255, filed Apr. 11, 2017.

BACKGROUND OF THE INVENTION

1. Field of Invention

This invention relates generally to containers for transporting heated food and more specifically, to a venting device for releasing steam from the container created by the heated food thereby preserving the temperature and texture of the food contained therein.

2. Description of Related Art

In our fast-paced society, fast food and takeout food has become the norm. In the U.S., restaurateurs have recognized the value in offering a takeout option for those families on the go and who want to enjoy their favorite restaurant food from the comfort of their home.

To provide this takeout option to their customers, restaurants use a variety of takeout containers specifically designed to contain the hot food. Typically, these containers are constructed of Styrofoam®, molded plastic, or cardboard. While these containers do a good job of retaining the heat of the food held within, inevitably, steam and moisture from the food condenses on the top surface of the interior of the container creating droplets of water and moisture that affect the texture of the food. The end result is unappetizing, soggy food by the time the customer reaches their home or destination. Thus, foods that are intended to be enjoyed crispy, such as fries, pizza, chips, fried foods, and the like, are very susceptible to absorbing the excess moisture and not ideal for transportation via a disposable takeout container.

Therefore, there exists a need for a venting device and method that reduces the amount of moisture in a hot food container preserving the temperature, crispness and texture of the food therein.

SUMMARY OF THE INVENTION

Disclosed herein is a venting device to allow for the release of steam and moisture. The venting device comprises a flat surface and at least four blades extending from the flat surface. The at least four blades include a straight portion and an angled portion such that the angled portion forms a point as illustrated in FIGS. 1 through 5. The flat surface allows for the stacking of containers without inhibiting the release of steam and moisture. In an alternative embodiment, the venting device does not comprise a solid flat surface as illustrated in FIGS. 4 and 5.

Also contemplated by the present disclosure is a method for venting steam and moisture from food containers. The method contemplated by this disclosure includes the steps of inserting the venting device disclosed herein to a point determined by the location of a protrusion located along the periphery of the blades. Food containers are stacked on the flat surface of the venting device thereby not inhibiting the release of steam and moisture from the food container below.

In an alternative embodiment, disclosed is a reusable hand push tool crafted easily to puncture and leave a hole in cardboard, paper, Styrofoam, plastics, and the like without leaving any loose debris behind from the food container. The design of this embodiment is such that a person can use the free hand to support one side of the container and push the tool through with the other. This embodiment may be crafted from assorted plastic and polypropylene or steel or metal. This embodiment is intended to be reusable and therefore washable and dishwasher safe.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
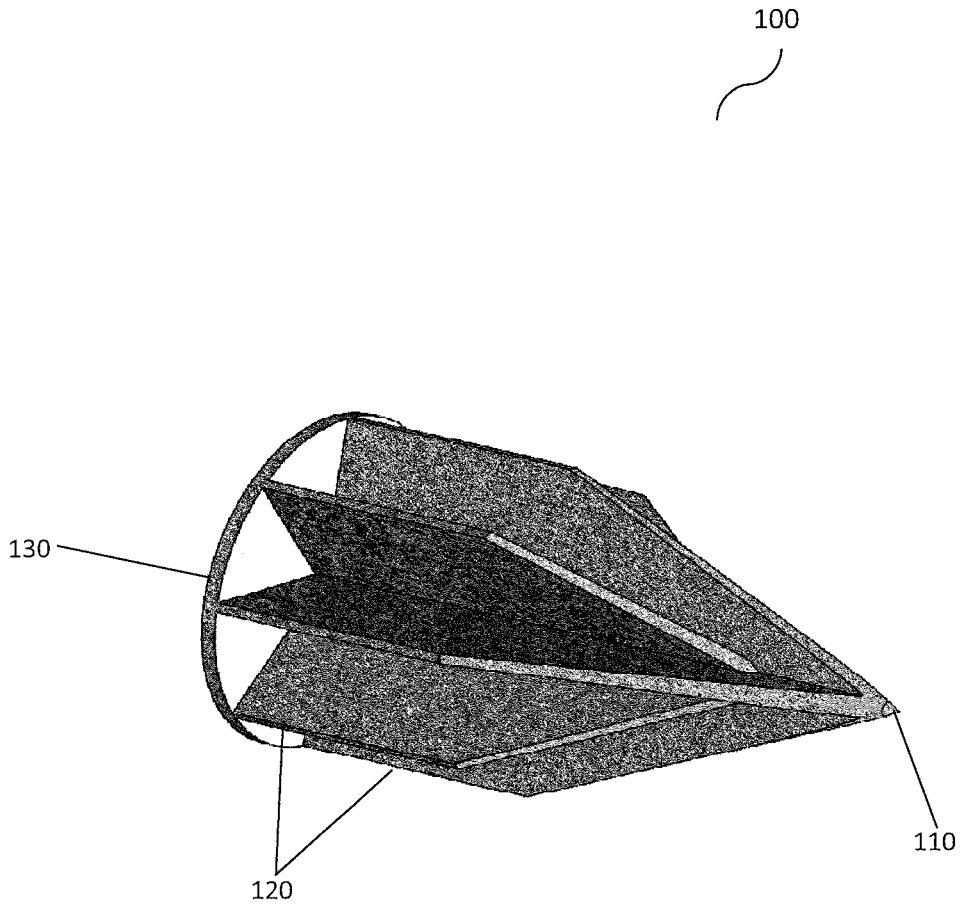
FIG. 1 illustrates an perspective view of a venting device according to an embodiment of the invention.

Preferred embodiments of the present invention and their advantages may be understood by referring to FIGS. 1-5, wherein like reference numerals refer to like elements. Although the present invention is described and illustrated in the context of hot food containers, it is to be understood that the disclosure of the present invention is not limited to this embodiment but is equally applicable to containers in general wherein venting is advantageous.

Figure 2:
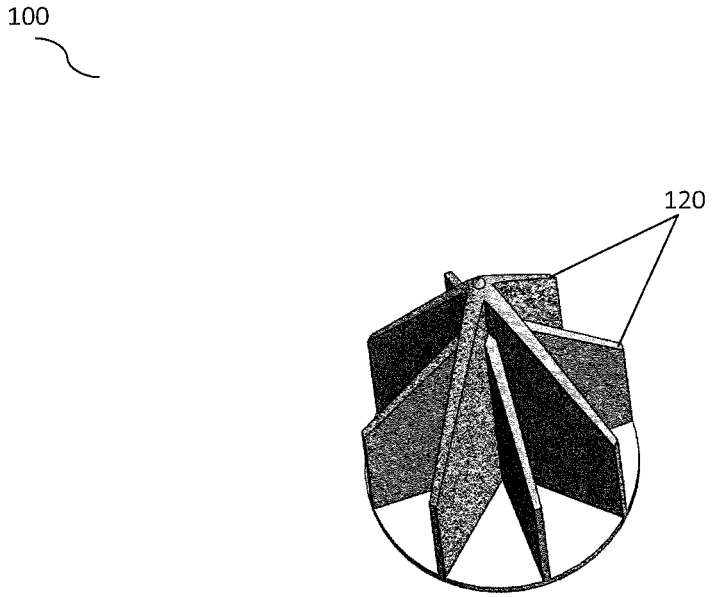
FIG. 2 illustrates an isometric top view of a venting device according to an embodiment of the invention.

Referring to FIG. 1, the venting device 100 is illustrated and may be used with any variety of hot food containers. The venting device 100 of the present invention may be constructed as a unitary device from any type of plastic that has heat resistant properties such as thermoplastics including but not limited to nylon, acrylic, polypropylene, polystyrene, and polyvinyl chloride. The present invention may also be constructed of wood or steel. The pointed tip 110 of the venting device 100 is inserted through the top, outside surface of a food container sufficiently to allow the conical blades 120 to puncture the surface of the container to allow venting of steam and moisture. In an embodiment, in order to properly vent steam and moisture, the present invention includes at least four conical blades 120. Preferably, the present invention includes at least six conical blades 120. More preferably, the present invention includes at least eight conical blades as shown in FIG. 2. In some embodiments, the conical blades 120 alternate in length as shown in FIGS. 1 and 2.

A flat, solid surface 130 of the venting device 100 provides a platform that protrudes from the top, outside surface of the food container sufficiently to allow stacking of multiple food containers. In this respect, the venting device 100 prevents stacked food containers from impacting the lid of the food container beneath and protecting the food therein from damage. In addition, in a stacked configuration, the flat, solid surface 130 permits the continued venting of steam and moisture for each stacked food container.

To facilitate use of the venting device 100 in a variety of hot food containers, the device may be constructed in a range of lengths. In some embodiments, the venting device 100 has a length between 0.5 inch to 3 inches; or 0.75 inch to 2.75 inches; or 1.0 inch to 2.5 inches; or 1.5 inches to 2.0 inches. The venting device 100 may be constructed in a range of widths. In some embodiments, the venting device 100 has a width between 0.5 inch and 2 inches; or 1 inch and 1.75 inches; or 1.25 inches and 1.5 inches.

The flat, solid surface 130 may also be of any shape. In a preferred embodiment, the flat, solid surface 130 is circular but in alternative embodiments, the flat, solid surface 130 may be, by way of non-limiting examples, rectangular or square. The shape of the flat, solid surface 130, however, will not affect the conical shape of the blades 120. The advantageous conical shape and taper of the blades 120 provides a venting device 100 easily inserted through more structurally sound food containers such as corrugated cardboard and paperboard.

In an alternative embodiment (not shown), the venting device 100 has along the periphery of the conical blades 120 a protrusion (not shown). The protrusion acts as a stop to prevent the venting device 100 from being inserted too far into the interior of the food container. In addition, the protrusion maintains the integrity of the venting device 100 when in a stacked configuration. In other words, the protrusion prevents the venting device 100 from proceeding further into the food container than desired or through the bottom thereof when added weight from stacked food containers is applied. The precise location of the protrusion will be dictated by 1) the type of food container; 2) the distance required for the flat, solid surface 130 to extend from the outside, top surface of a food container; and 3) the height of the interior cavity of the food container. These factors will likewise dictate the overall length of the venting device 100. Advantageously, the venting device 100 is lightweight, inexpensive device capable of mass production to fit a variety of takeout food containers.

Referring to FIG. 2, a top isometric view of the venting device 100 is illustrated. FIG. 2 shows the alternating conical blades 120 of a preferred embodiment of the present invention.

Figure 3:
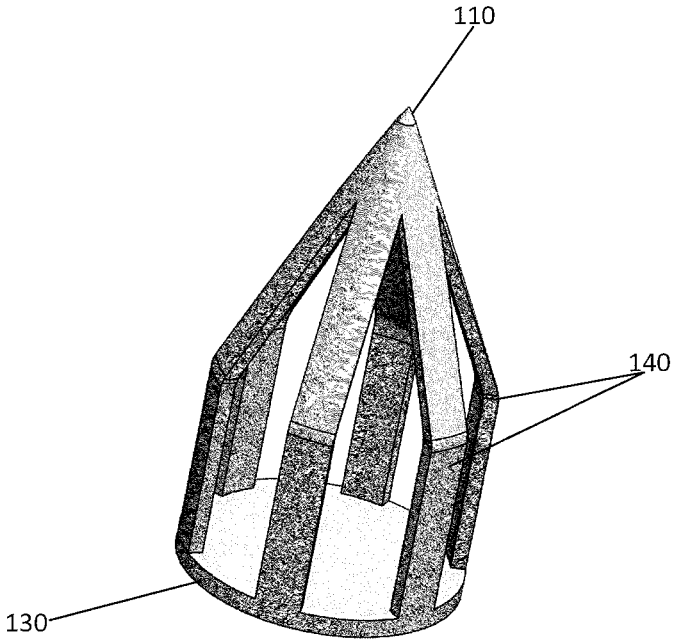
FIG. 3 illustrates an isometric view of a venting device according to an alternative embodiment of the invention.

Referring to FIG. 3 is an alternative embodiment of the present invention. The alternative embodiment of FIG. 3 includes legs 140 originating from the flat, solid surface 130 and forming a conical structure that terminates at the pointed tip 110. In this embodiment, the legs 140 create a hollow cavity within the interior of the legs 140. The hollow cavity permits venting of steam and moisture from the food container. In this embodiment, the present invention includes at least four legs 140. Preferably, the present invention includes at least six legs 140. The legs 140 may be flat, curved, or round.

The venting device 100 of FIG. 3 may also include along the periphery of the legs 140 a protrusion (not shown). The protrusion acts as a stop to prevent the venting device 100 from being inserted too far into the interior of the food container. In addition, the protrusion maintains the integrity of the venting device 100 when in a stacked configuration.

Because the venting device 100 is positioned through the outside, top surface of a takeout food container, the steam and moisture are vented to the outside thereby minimizing the condensation on the interior of the container. Accordingly, the hot food contained in the food container retains its temperature, crispness and texture.

Figure 4:
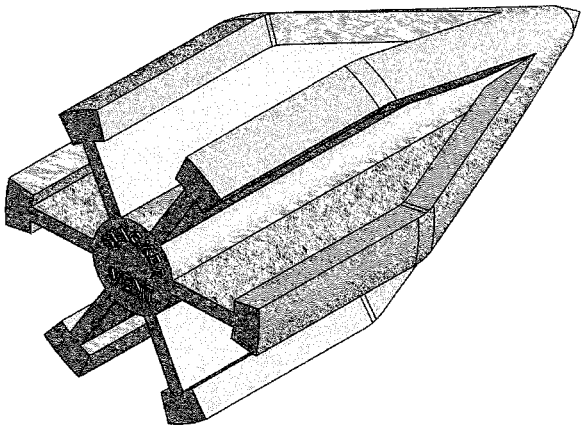
FIG. 4 illustrates an isometric view of an alternative embodiment of the venting device as illustrated in FIG. 1.
Figure 5:
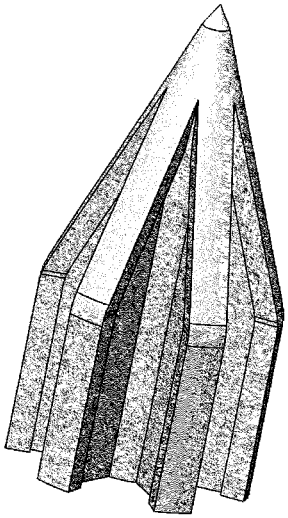
FIG. 5 illustrates a perspective view of the alternative embodiment of a venting device as illustrated in FIG. 1.

Referring now to FIGS. 4 and 5 is illustrated an alternative embodiment that does not include the solid surface 130 of FIG. 1. In this alternative embodiment, the conical blades are flattened on their ends opposite the pointed tip 110. This flattened surface provides a platform that protrudes from the top, outside surface of the food container sufficiently to allow stacking of multiple food containers.

In an alternative embodiment, the present invention contemplates a venting device that facilitates the creation of venting apertures in the surface of a food container. In this alternative embodiment, the venting device includes an ergonomic handle and at least four conical protrusions to allow the venting device to easily puncture the surface of a food container. The four apertures created in the food container by the venting device allow venting of steam and moisture. Advantageously, the venting device easily penetrates a variety of materials making up food containers common in the industry including, but not limited to, thermoplastics, corrugated cardboard and paperboard. The venting device of the alternative embodiment may be constructed as a unitary device from any type of thermoplastics including but not limited to nylon, acrylic, polypropylene, polystyrene, and polyvinyl chloride. The alternative embodiment may also be constructed of wood or steel.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Moreover, the described features, structures, or characteristics of the invention may be combined in any suitable manner in one or more embodiments. It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents. Reference will now be made in detail to the preferred embodiments of the invention.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A venting device to allow for the release of steam and moisture from a food container comprising:

a food container;

a venting device for insertion into the top surface of the food container, comprising:

a flat surface; and at least four conical blades extending upwardly from the flat surface;

wherein the at least four conical blades include a straight portion and an angled portion such that the angled portion forms a point for insertion into a top surface of the food container; and wherein the flat surface allows for the stacking of food containers without inhibiting the release of steam and moisture from the food container below.

2. The venting device of claim 1, wherein the device is constructed of materials selected from the group consisting of nylon, acrylic, polypropylene, polystyrene, and polyvinyl chloride, corrugated cardboard, and paperboard.

3. The venting device of claim 1, where in the flat surface is circular.

4. The venting device of claim 1, wherein the length of the device is between 0.5 inch to 3 inches.

5. The venting device of claim 1, where the width of the device is between 0.5 inch and 2 inches.

6. The venting device of claim 1, further comprising means along the periphery of the at least four blades to act as a stop to prevent the device from penetrating too far into the interior of a food container.

7. A venting device to allow for the release of steam and moisture from a food container comprising:

a food container;

a venting device for insertion into the top surface of the food container, comprising:

at least four blades extending radially from a central portion;

wherein the at least four blades include a straight portion and an angled portion such that the angled portion forms a point for insertion into the top surface of the food container; and wherein the at least four blades radially extending from the central portion form a flat surface that allows for the stacking of food containers without inhibiting the release of steam and moisture from the food container below.

8. The venting device of claim 7, wherein the device is constructed of materials selected from the group consisting of nylon, acrylic, polypropylene, polystyrene, and polyvinyl chloride, corrugated cardboard, and paperboard.

9. The venting device of claim 7, wherein the length of the device is between 0.5 inch to 3 inches.

10. The venting device of claim 7, where the width of the device is between 0.5 inch and 2 inches.

11. The venting device of claim 7, further comprising means along the periphery of the at least four blades to act as a stop to prevent the device from penetrating too far into the interior of a food container.

12. A method for venting steam and moisture from food containers, comprising the step of:

inserting a venting device into a top surface of a food container, the venting device comprising a flat surface and at least four blades extending from the flat surface, wherein the at least four blades include a straight portion and an angled portion such that the angled portion forms a point for insertion into a top surface of a food container; and wherein insertion of the venting device is restricted by means along the periphery of the at least four blades to avoid penetrating too far into the interior of the food container; and wherein food containers may be stacked on the flat surface of the venting device without inhibiting the release of steam and moisture from the food container below.

* * * * *